US006671898B1

(12) United States Patent
Eggenberger et al.

(10) Patent No.: US 6,671,898 B1
(45) Date of Patent: Jan. 6, 2004

(54) WATER FITTING

(75) Inventors: Walter Eggenberger, Tann-Rüti (CH); Christoph Hauser, Rüti (CH); Jochen Marquart, Rapperswil (CH)

(73) Assignee: Geberit Technik AG (CH)

( * ) Notice: Subject to any disclaimer, the term of this patent is extended or adjusted under 35 U.S.C. 154(b) by 54 days.

(21) Appl. No.: 10/111,300

(22) PCT Filed: Jun. 14, 2000

(86) PCT No.: PCT/CH01/00369

§ 371 (c)(1),
(2), (4) Date: Apr. 22, 2002

(87) PCT Pub. No.: WO02/16704

PCT Pub. Date: Feb. 28, 2002

(30) Foreign Application Priority Data

Aug. 23, 2000 (CH) ..... 1641/00

(51) Int. Cl.[7] ..... F16K 31/00

(52) U.S. Cl. ..... 4/623; 4/695; 137/801; 251/128; 251/129.04

(58) Field of Search ..... 251/128, 129.04; 4/623, 695; 137/801

(56) References Cited

U.S. PATENT DOCUMENTS

| | | | | | |
|---|---|---|---|---|---|
| 4,735,357 | A | * | 4/1988 | Gregory et al. | 137/801 |
| 5,092,560 | A | * | 3/1992 | Chen | 251/129.04 |
| 5,169,118 | A | * | 12/1992 | Whiteside | 251/129.04 |
| 5,586,746 | A | | 12/1996 | Humpert et al. | 251/129.04 |
| 5,618,023 | A | * | 4/1997 | Eichholz et al. | 251/129.04 |
| 5,961,095 | A | * | 10/1999 | Schrott | 251/129.04 |
| 6,082,407 | A | * | 7/2000 | Paterson et al. | 4/623 |

FOREIGN PATENT DOCUMENTS

EP 0 688 909 A * 12/1995

* cited by examiner

*Primary Examiner*—John Bastianelli
(74) *Attorney, Agent, or Firm*—Webb Ziesenheim Logsdon Orkin & Hanson, P.C.

(57) ABSTRACT

The invention relates to a water fitting including a pipe having at least one water hook-up that is connected to a valve. A housing is detachably connected to the pipe and has a spout line that, when installed, is connected to the outlet of the valve. A screw secures the housing on the pipe. A sensing device is fitted inside the pipe. When the screw is removed, said sensing device automatically closes the valve and blocks the same in the closed position. This reliably prevents water from flowing out when the housing is disassembled.

9 Claims, 2 Drawing Sheets

WATER FITTING

BACKGROUND OF THE INVENTION

A water fitting is disclosed in EP-A-688.909. This water fitting has an electrical control system. A pipe has connections for hot water and cold water. In the pipe there is an adjustable mixing valve. Downstream of said mixing valve is a solenoid valve, the output of which empties into an arm with a water discharge mouthpiece. Also installed in the pipe is a proximity detector which automatically turns on the solenoid valve when a hand approaches the fitting.

SUMMARY OF THE INVENTION

An object of the invention is to achieve a safe and reliable installation and removal of the housing for maintenance. This object is accomplished by providing a water fitting having a sensor that registers the presence of a securing element and, when the securing element is removed, switches a valve to its closed position and locks the valve in the closed position.

BRIEF DESCRIPTION OF THE DRAWINGS

One exemplary embodiment of the invention is explained in greater detail below with reference to the accompanying drawings, in which.

DESCRIPTION OF THE PREFERRED EMBODIMENT

Figure 1:
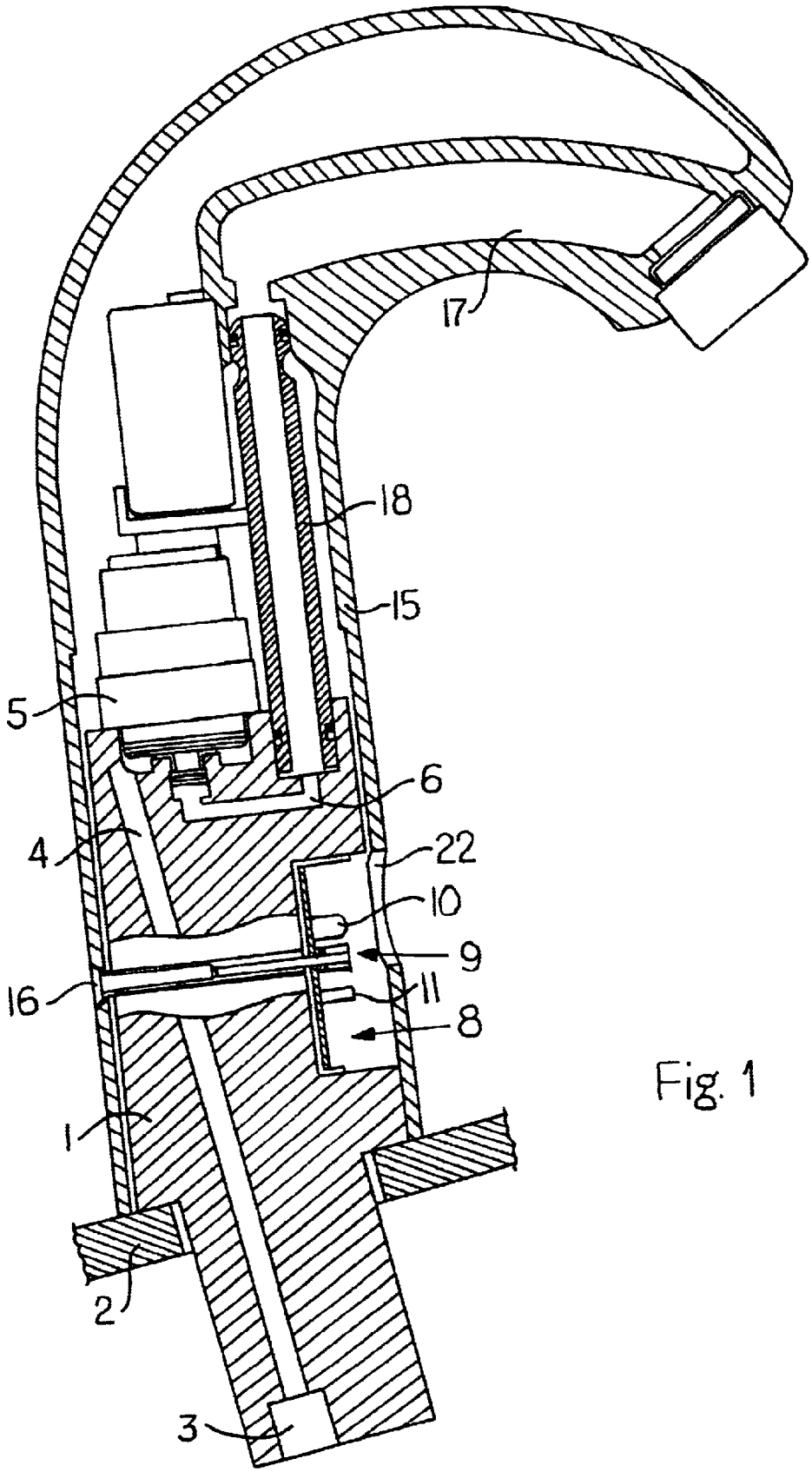
FIG. 1 is a longitudinal section through a water fitting.
Figure 2:
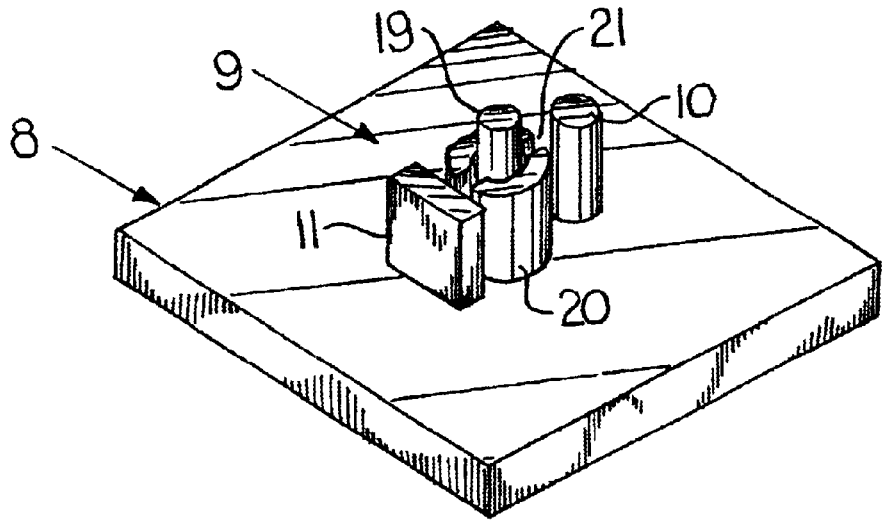
FIG. 2 is a view of a sensor of the invention in perspective.
Figure 3:
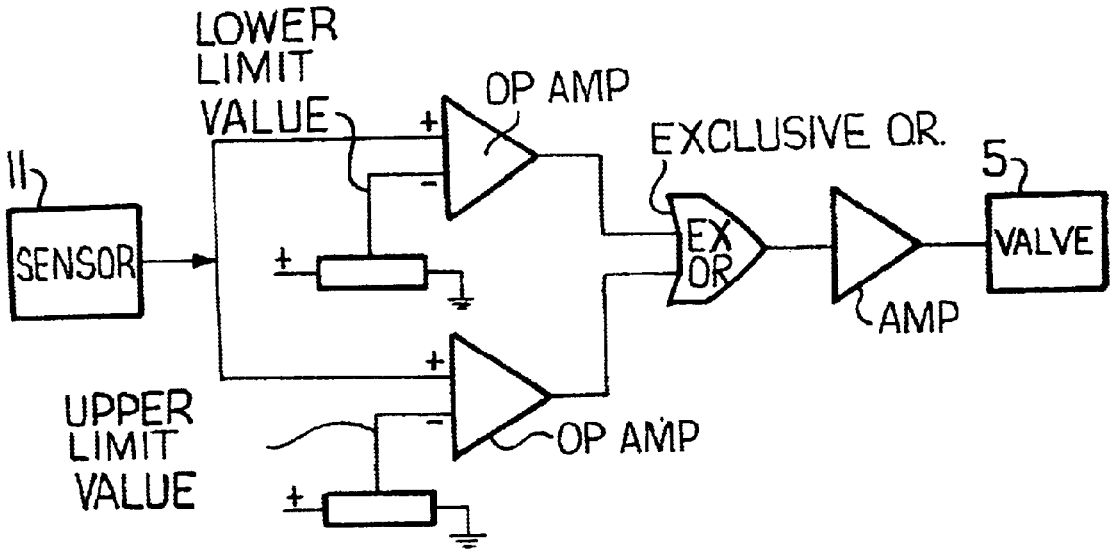
FIG. 3 is a circuit diagram of a water fitting of the invention.

The water fitting comprises a cylindrical pipe 1 which can be fastened to a washbasin 2, for example. The pipe 1 has at least one water connection 3. The connection 3 is connected via a line 4 with the input of a solenoid diaphragm valve 5. The output of said solenoid diaphragm valve 5 leads to an outlet channel 6. In the pipe 1 there is also a conventional electronic unit 8 with a battery-powered proximity sensor 9 to automatically turn on the valve 5 when an object approaches. The proximity sensor 9 is realized in the form of a photoelectric barrier with a transmitter diode 10 and a receiver diode 11.

Attached to the pipe 1 is a curved, tubular housing 15 which is secured with a screw 16. Located in the housing 15 is a delivery line 17 which is connected with the channel 6 by means of an insertable line 18. The free end 19 of the screw 16 projects into a pipe 20 which is located between the diodes 10, 11 on the unit 8. The pipe 20 has, on the connecting line between the diodes 10, 11, a rectangular slot 21 which is narrower than the diameter of the end 19. In front of the diodes 10, 11, the housing 15 has a window 22 that is made of a transparent panel.

The receiver diode 11 measures not only the light reflected by the approaching object, but also light reflected from the immediate vicinity of the diodes 10, 11. The operation of the unit 8 is coordinated so that this scattered light has no influence on the operation of the valve 5.

When the screw 16 is removed, a direct optical connection is established between the transmitter diode 10 and the receiver diode 11. In other words, the tuning of the unit is significantly altered. The invention now teaches that the unit 8 is configured so that the valve 5 is automatically turned off when this condition occurs. The unit 8 therefore not only has a lower limit value for the light intensity received by the receiver diode 11, whereby the valve 5 turns on when this lower limit value is exceeded, but also an upper limit value, whereby the valve 5 is automatically turned off when said upper limit value is exceeded, regardless of whether there is an object, i.e., a hand, in the vicinity of the sensor 9. Both limit values are adjustable.

The scanning can also be performed with a special receiver diode (2 receiver diodes).

The valve 5 closes after a certain delay in response to the closing signal. Because it takes a certain amount of time to loosen the screw 16, the invention ensures that the valve 5 is closed in good time before the housing 15 can be pulled away from the pipe 1. As a result of the realization taught by the invention, no water can flow out of the fitting when the housing 15 is removed for maintenance purposes, e.g. to replace the battery.

The realization taught by the invention is naturally also suitable for fittings with a cold water and hot water connection and an adjustable mixing valve that is located upstream or downstream of the on-off valve 5.

What is claimed is:

1. A water fitting, comprising:

a pipe having at least one water connection;

a valve fastened to the pipe, which valve is connected with the at least one water connection and when the valve is turned on connects the at least one water connection with an output channel;

a housing detachably connected with the pipe and having a delivery line for the water, which delivery line is connected via another line with the output channel;

a mechanical securing element which secures the housing to the pipe; and a sensor which registers the presence of the securing element and, when said securing element is removed, switches the valve into a closed position and locks the valve in said closed position.

2. The water fitting as claimed in claim 1, wherein the securing element is a screw.

3. The water fitting as claimed in claim 2, wherein a free end of the screw, when said screw is installed, interrupts an optical connection between a transmitter diode and a receiver diode of a photoelectric barrier.

4. The water fitting as claimed in claim 3, wherein the photoelectric barrier also forms a proximity sensor to open the valve at the approach of an object.

5. A method to interrupt the water feed to a delivery line in a housing of a water fitting as claimed in claim 1, comprising:

automatically turning off the valve by a mechanical display means when the display means are moved from their installed position.

6. The method as claimed in claim 5, wherein a part of a fastening screw is scanned by a photoelectric barrier which controls the valve.

7. The method as claimed in claim 6, wherein the photoelectric barrier is a proximity sensor for an object.

8. The method as claimed in claim 6, wherein when the fastening screw is removed, the valve is held in the closed position.

9. The method as claimed in claim 8, wherein the photoelectric barrier is a proximity sensor for an object.

* * * * *